US005595845A

United States Patent [19]

Maeda et al.

[11] Patent Number: 5,595,845

[45] Date of Patent: Jan. 21, 1997

[54] ELECTROPHOTOGRAPHIC PHOTOSENSITIVE MEMBER, ELECTROPHOTOGRAPHIC APPARATUS INCLUDING SAME AND ELECTROPHOTOGRAPHIC APPARATUS UNIT

[75] Inventors: Tatsuo Maeda, Toride; Hideki Anayama, Yokohama; Yoichi Kawamorita, Chigasaki; Hiroyuki Ohmori, Tokyo; Mayumi Kimura, Kawasaki, all of Japan

[73] Assignee: Canon Kabushiki Kaisha, Tokyo, Japan

[21] Appl. No.: 489,133

[22] Filed: Jun. 9, 1995

[30] Foreign Application Priority Data

Jun. 10, 1994 [JP] Japan ..... 6-128774

[51] Int. Cl.[6] ..... G03G 5/047; G03G 15/22

[52] U.S. Cl. ..... 430/58; 430/59; 399/161

[58] Field of Search ..... 430/58, 59; 355/211

[56] References Cited

U.S. PATENT DOCUMENTS

| | | | |
|---|---|---|---|
| 4,728,592 | 3/1988 | Ohaku et al. | 430/59 |
| 4,943,501 | 7/1990 | Kinoshita et al. | 430/58 |
| 5,013,625 | 5/1991 | Takizawa et al. | 430/64 |
| 5,102,759 | 4/1992 | Fuse et al. | 430/59 |
| 5,130,222 | 7/1992 | Otsuka et al. | 430/126 |
| 5,132,197 | 7/1992 | Iuchi et al. | 430/76 |
| 5,166,019 | 11/1992 | Ueda et al. | 430/58 |
| 5,272,028 | 12/1993 | Kashizaki et al. | 430/58 |
| 5,336,578 | 8/1994 | Nukada et al. | 430/78 |

FOREIGN PATENT DOCUMENTS

| | | |
|---|---|---|
| 0567396 | 10/1993 | European Pat. Off. . |
| 0586965 | 3/1994 | European Pat. Off. . |
| 50-33857 | 11/1975 | Japan . |
| 56-130759 | 10/1981 | Japan . |
| 57-122444 | 7/1982 | Japan . |
| 60-256150 | 12/1985 | Japan . |
| 61-239248 | 10/1986 | Japan . |
| 62-39863 | 2/1987 | Japan . |
| 62-67094 | 3/1987 | Japan . |
| 62-105151 | 5/1987 | Japan . |
| 63-18356 | 1/1988 | Japan . |
| 63-50851 | 3/1988 | Japan . |
| 63-73254 | 4/1988 | Japan . |
| 3-37656 | 2/1991 | Japan . |
| 3-128973 | 5/1991 | Japan . |
| 3-200790 | 9/1991 | Japan . |
| 4-51248 | 2/1992 | Japan . |

OTHER PUBLICATIONS

Database WP1, Week 8913, Derwent Publ., AN–89–096895 [13].

Binder, et al., "The Structure and Configuration of Dihydroxydiphenyl Sulfides Derived from Alkylcresols by Infrared Spectra", J.A.C.S., vol. 81, No. 14, pp. 3608–3610 (1959).

*Primary Examiner*—Roland Martin

*Attorney, Agent, or Firm*—Fitzpatrick, Cella, Harper & Scinto

[57] ABSTRACT

An electrophotographic photosensitive member is constituted by disposing charge generation layer and a charge transport layer in succession on a support. The charge generation layer contains oxytitanium phthalocyanine, an azo pigment and a hindered phenol. The electrophotographic photosensitive member including such a charge generation layer is usable for providing an apparatus unit and an electrophotographic apparatus showing excellent electrophotographic characteristics such as a suppressed photomemory, good potential stability in repetitive use and good image-forming properties.

11 Claims, 2 Drawing Sheets

ELECTROPHOTOGRAPHIC PHOTOSENSITIVE MEMBER, ELECTROPHOTOGRAPHIC APPARATUS INCLUDING SAME AND ELECTROPHOTOGRAPHIC APPARATUS UNIT

FIELD OF THE INVENTION AND RELATED ART

The present invention relates to an electrophotographic photosensitive member, an electrophotographic apparatus including the photosensitive member and an electrophotographic apparatus unit including the photosensitive member.

Heretofore, there have been used inorganic photoconductive materials, such as selenium, cadmium sulfide and zinc oxide, as a photoconductor for an electrophotographic photosensitive member. On the other hand, there have recently been efforts to use electrophotographic photosensitive members employing organic photosensitive materials having the advantages of inexpensiveness, high productivity and (environmental) pollution-free characteristics.

Particularly, in recent years, there have been widely popularized non-impact type printers utilizing electrophotography as a terminal printer instead of conventional impact-type printers. These printers are laser beam printers using lasers as a light source in general. As the light source, semiconductor lasers are generally used in view of cost, apparatus size, etc. Semiconductor lasers generally used at present have a relatively longer wavelength (i.e., emission wavelength: 780±20 nm), so that electrophotographic photosensitive members having a sufficient sensitivity to laser light showing such a longer wavelength have been studied and developed.

There have been studied and proposed many charge-generating materials having a high sensitivity to long-wavelength light, among which phthalocyanine compounds such as non-metallic phthalocyanine, copper phthalocyanine and oxytitanium phthalocyanine (hereinbelow, abbreviated as "TiOPc").

Particularly, oxytitanium phthalocyanine (TiOPc) shows a very high photosensitive characteristic and has various crystal forms which is similar to the condition of other phthalocyanine compounds. Further, electrophotographic characteristics of TiOPc vary depending upon a difference in crystal form, so that many types of TiOPcs having various crystal forms have been studied and proposed.

Representative examples thereof may include: αa-type TiOPc as disclosed in Japanese Laid-Open Patent Application (JP-A) 61-239248 (corr. to U.S. Pat. No. 4,728,592), β-type TiOPc as disclosed in JP-A 62-67094 (U.S. Pat. No. 4,664,977), I-type TiOPc as disclosed in JP-A 3-128973 and Y-type TiOPc as disclosed in JP-A 3-200790.

However, when conventional electrophotographic photosensitive members using TiOPc were adopted in a so-called Carlson Process including the steps of, e.g., charging, exposure, development and transfer, the photosensitive members were liable to cause deterioration or lowering in image quality due to a decrease in surface potential and a change in photosensitivity.

This reason has not been clarified as yet and many factors have been considered.

Generally, in case where an electrophotographic photosensitive member is used in a copying machine, the photosensitive member is always subjected to an atmosphere of corona discharge. With an increase in the number of copied sheets, the photosensitive member is affected by a gas generated due to corona discharge, thus accelerating a deterioration of the photosensitive member.

In order to prevent such a deterioration of the photosensitive member, there have been proposed a method of adding an antioxidant (anti-oxidizing agent), such as trialkylphenolic derivatives or dilauryl tiodipropionate, to a charge transport layer (Japanese Patent Publication (JP-B) Nos. 50-33857 and 51-34736, JP-A 56-130759, JP-A 57-122444, etc.).

In order to further improve the effect of the antioxidant suppressing the deterioration of the photosensitive member, there have also been proposed various methods as descried in JP-A Nos. 62-105151, 62-39863, 63-18356, 63-50851, 63-73254, and 4-51248).

However, the above proposals have failed to provide sufficient electrophotographic characteristics.

JP-A 60-256150 has also descried TiOPc coated with a charge transport material and/or an antioxidant. The resultant photosensitive member, however, has exhibited the following defects although deterioration thereof has been prevented to some extent. More specifically, as described in JP-A 60-256150, when TiOPc was dissolved or dispersed in a solvent of, e.g., tetrahydrofuran together with an antioxidant and then was subjected to drying at high temperature, the crystallizability of TiOPc was liable to be changed, thus failing to obtain a desired photosensitivity.

JP-A 62-39863 and JP-A 63-18356 have described the addition of an antioxidant (e.g., a hindered phenol) to a charge generation layer. The addition is effective in preventing oxidation to some extent but is not necessarily sufficient to improve electrophotographic characteristics including suppression of a photomemory phenomenon described hereinafter.

JP-A 3-37656 has described the use of TiOPc and a particular bisazo pigment in a photosensitive member. However, there has been a still room for improvement in electrophotographic characteristics including a photomemory characteristic.

When an electrophotographic photosensitive member is exposed to visible light during, e.g., treatment of jamming, a carrier is naturally generated at the exposed portion. If an electrophotographic process is started while the above carrier is left in the exposed portion, an electric (charge) potential at the exposed portion having the carrier is partially neutralized. As a result, an absolute value of the electric potential is lowered, thus resulting in image defects. This phenomenon is called "photomemory (PM)".

In recent years, with a demand for high quality image, an electrophotographic photosensitive member is required to have not only a high photosensitivity and a high durability but also an excellent characteristic against a photomemory.

SUMMARY OF THE INVENTION

An object of the present invention is to provide an electrophotographic photosensitive member having an excellent stability of electric potential in repetitive use and substantially causing no photomemory.

Another object of the present invention is to provide an electrophotographic apparatus including the photosensitive member and provide an electrophotographic apparatus unit including the photosensitive member.

According to the present invention, there is provided an electrophotographic photosensitive member, comprising: a support, a charge generation layer disposed on the support and a charge transport layer disposed on the charge generation layer, wherein the charge generation layer comprises oxytitanium phthalocyanine, an azo pigment and a hindered phenol.

The present invention provides an electrophotographic apparatus, comprising: the electrophotographic photosensitive member as described above, a charging means for charging the electrophotographic photosensitive member, an image-exposure means for effecting image-exposure to the electrophotographic photosensitive member to form an electrostatic latent image, and a developing means for developing the electrostatic latent image with a toner.

The present invention further provides an electrophotographic apparatus unit, comprising: the electrophotographic photosensitive member as described above and a direct charging member contacting and charging the electrophotographic photosensitive member.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
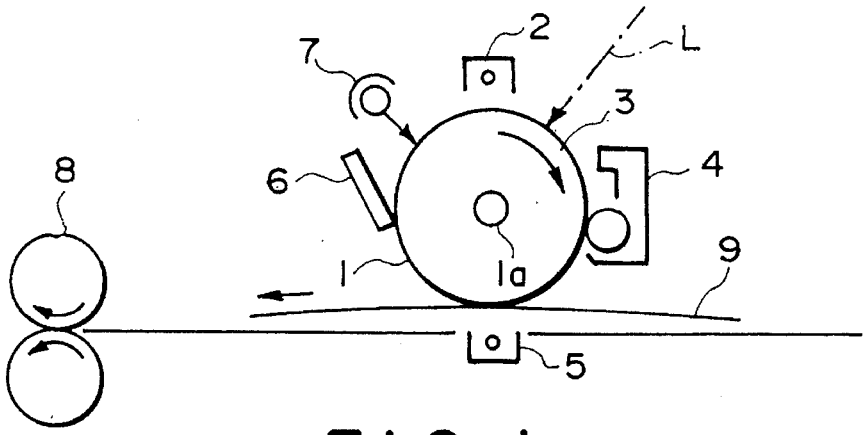
FIGS. 1–3 are schematic structural views each showing an embodiment of an electrophotographic apparatus using the electrophotosensitive member according to the present invention.

The electrophotographic photosensitive member according to the present invention is characterized by a charge generation layer at least comprising TiOPC, an azo pigment and a hindered phenol.

In the present invention, both of an azo pigment and a hindered phenol are incorporated in a charge generation layer together with TiOPc in combination, whereby the resultant electrophotographic photosensitive member shows a stable electric potential during repetitive use and prevents occurrence of a photomemory phenomenon.

The reason why the photosensitive member according to the present invention is effective in preventing a photomemory phenomenon has not been clarified as yet. This may attributable to the following presumption.

When oxytitanium phthalocyanine (TiOPc) is excited by short-wavelength light, a difference in energy level between an orbit in which an excited electron is present and an original orbit (i.e., an orbit in which an electron before excitation is present) becomes too large. As a result, it is difficult to recombine the excited electron (i.e., it is difficult to return the excited electron to the original orbit). However, the excited electron of TiOPc can presumably be smoothly recombined (returned to the original orbit) by way of blank orbits of an azo pigment and a hindered phenol since energy levels of blank orbits of an azo pigment and a hindered phenol are presumed to lie between energy levels of the orbitals of TiOPc before and after the excitation. Accordingly, the combination of TiOPc, an azo pigment and a hindered phenol contained in the charge generation layer of the photosensitive member according to the present invention may be effective in suppressing the photomemory phenomenon.

TiOPc (oxytitanium phthalocyanine) used in the present invention may generally have a structure represented by the following formula:

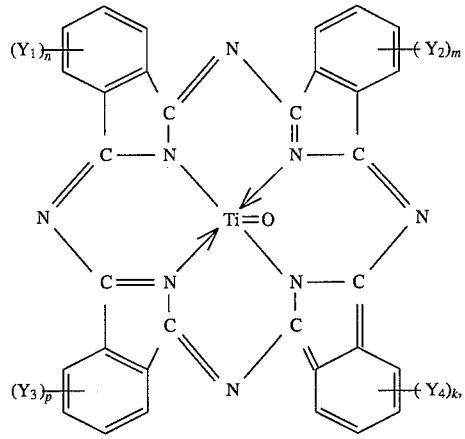

wherein $Y_1$, $Y_2$, $Y_3$ and $Y_4$ respectively denote Cl or Br; and n, m, k and p are respectively an integer of 0–4.

The TiOPc used in the present invention may have any crystal form. In the present invention, the TiOPc may preferably be a-type TiOPc, β-type TiOPc, I-type TiOPc or Y-type TiOPc, particularly I-type TiOPc.

The I-type TiOPc has a crystal form characterized by at least four main peaks specified by Bragg angles (2θ±0.2 degree) of 9.0 degrees, 14.2 degrees, 23.9 degrees and 27.1 degrees in X-ray diffraction pattern based on CuKα characteristic X-ray.

The α-type TiOPc has a crystal form characterized by at least two main peaks specified by Bragg angles (2θ±0.2 degree) of 7.6 degrees and 28.6 degrees in X-ray diffraction pattern based on CuKα characteristic X-ray.

The β-type TiOPc has a crystal form characterized by at least two main peaks specified by Bragg angles (2θ±0.2 degree) of 9.3 degrees and 26.3 degrees in X-ray diffraction pattern based on CuKα characteristic X-ray.

The Y-type TiOPc has a crystal form characterized by at least two main peaks specified by Bragg angles (2θ±0.2 degree) of 9.5 degrees and 27.3 degrees in X-ray diffraction pattern based on CuKα characteristic X-ray.

TiOPc (including those of I-type, α-type, β-type and Y-type) used in the present invention may generally be prepared according to processes as described in, e.g., U.S. Pat. No. 5,132,197, JP-A Nos. 61-239248, 62-67094, 3-128973, 3-200790, 3-37656, etc.

Herein, the conditions of the X-ray diffraction analysis using CuKα characteristic X-rays were as follows:

Measuring machine: X-ray diffraction apparatus (RAD-A system; manufactured by Rigaku Denki K. K.)

X-ray tube (Target): Cu

Tube voltage: 50 KV

Tube current: 40 mA

Scanning method: 2θ/θ scan

Scanning speed: 2 deg./min.

Sampling width: 0.020 deg.

Starting angle (2θ): 3 deg.

Stopping angle (2θ): 40 deg.

Divergence slit: 0.5 deg.

Scattering slit: 0.5 deg.

Receiving slit: 0.3 mm

Curved monochromator: used.

The azo pigment used in the present invention may preferably include those represented by the following formulae (1) to (3).

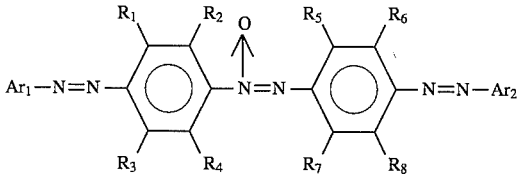

(1)

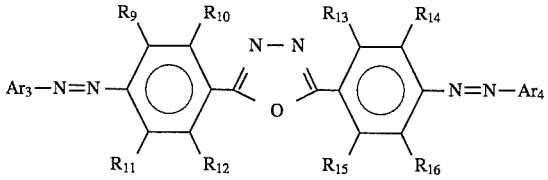

(2)

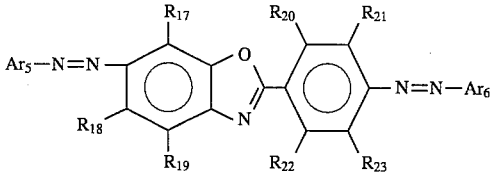

(3)

In the above, $Ar_1$ to $Ar_6$ independently denote a coupler residue and may preferably be selected from the following groups (i) to (iv).

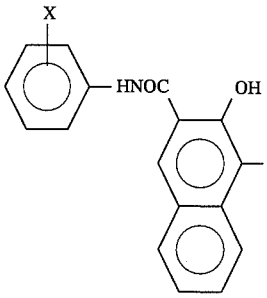

(i)

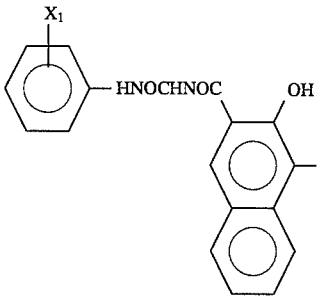

(ii)

-continued

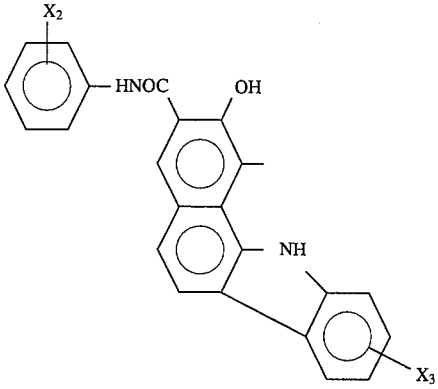

(iii)

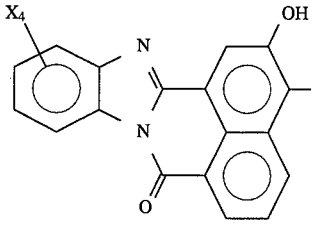

(iv)

In the above groups (i)–(iv), each of $X_1$ to $X_4$ is halogen atom and may preferably be fluorine, chlorine or bromine.

In the formulae (1)–(3), each of $R_1$ to $R_{23}$ may preferably be a substituted or unsubstituted alkyl group, a substituted or unsubstituted aryl group, hydrogen atom, or halogen atom. $R_1$ to $R_{20}$, $R_{22}$ and $R_{23}$ may more preferably be hydrogen atom and $R_{21}$ may more preferably be methyl group.

Particularly preferred examples of the azo pigment used in the present invention may include those represented by the formula (4) below.

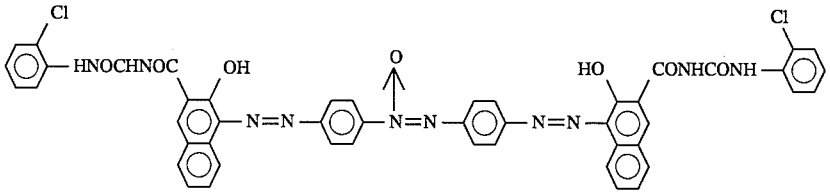

(4)

The azo pigment used in the present invention as described above may be synthesized through known processes as described in, e.g., U.S. Pat. No. 5,272,028.

Herein, "hindered phenol" refers to phenolic compounds having at least an ortho substituent (a substituent in the ortho position with respect to the phenolic OH group). Examples of the ortho substituent may include groups having a secondary or tertiary carbon atom connected to the benzene ring. Preferred examples thereof are α-methylbenzyl (or styratyl) group and tert-butyl group.

Preferred examples of the hindered phenol used in the present invention may include those represented by the following formulae (I-1) to (I-24).

(I-1)

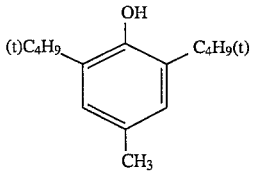

(I-2)

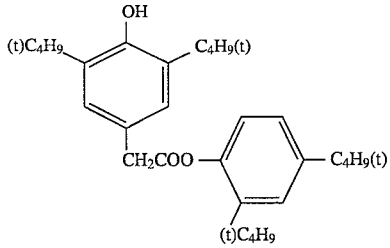

(I-3)

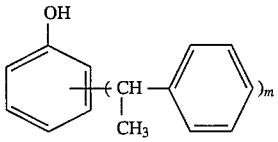

(m: an integer of 1–5)

(I-4)

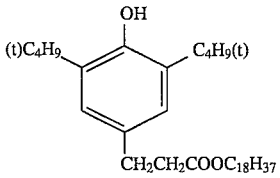

(I-5)

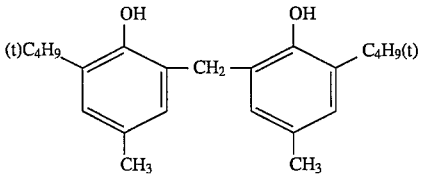

(I-6)

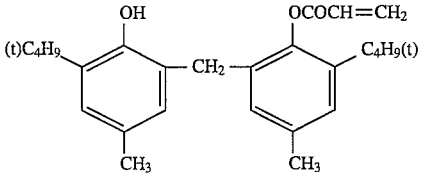

(I-7)

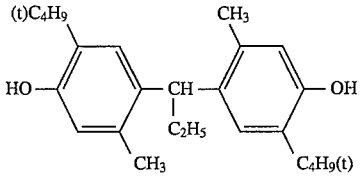

(I-8)

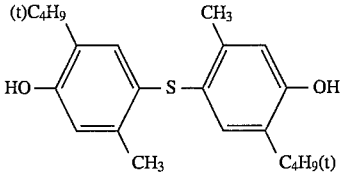

(I-9)

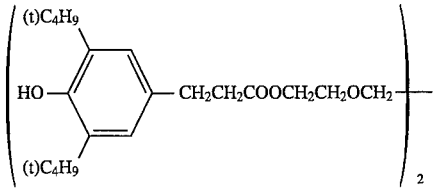

(I-10)

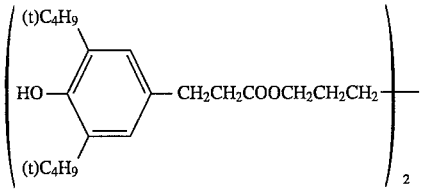

(I-11)

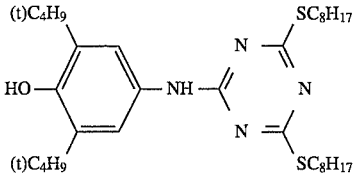

(I-12)

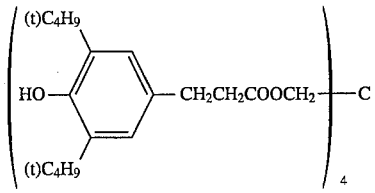

(I-13)

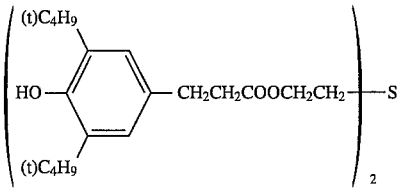

(I-14)

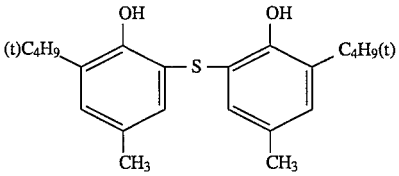

(I-15)

-continued
(I-16)
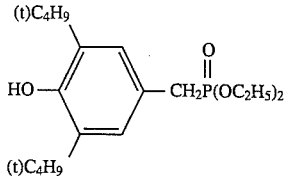
(I-17)
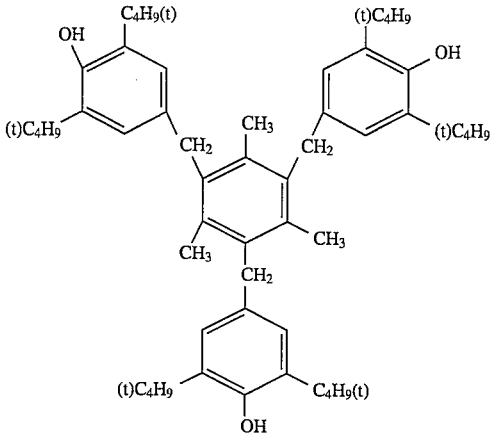
(I-18)
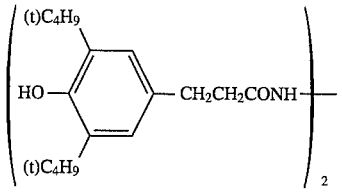
(I-19)
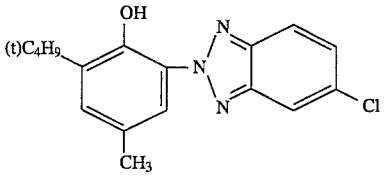
(I-20)
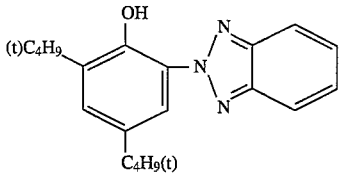
(I-21)
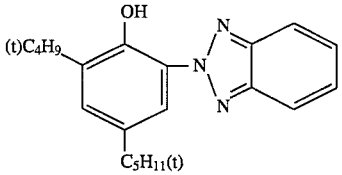
(I-22)
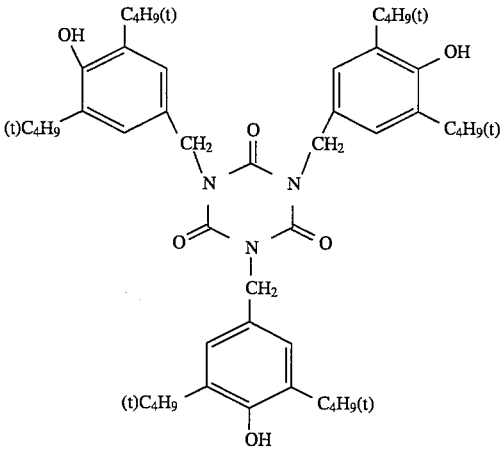
(I-23)
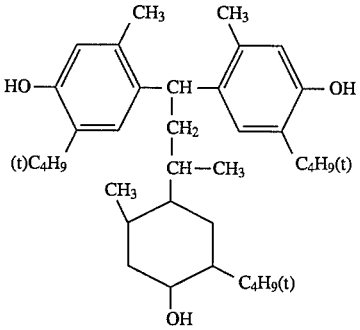
(I-24)
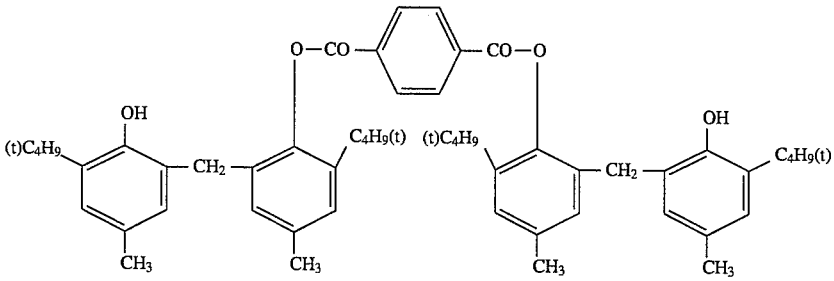
More preferred examples of the hindered phenol used herein are those containing sulfur, among which those represented by the following formulae (I-25) and (I-26) are particularly preferred.

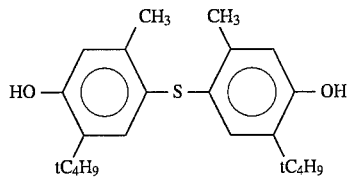

(I-25)

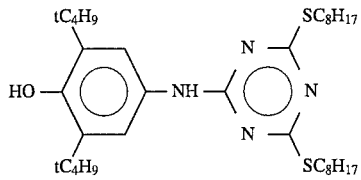

(I-26)

The hindered phenol used in the present invention may be synthesized through known processes as described in, e.g., "JACS", 81 (1959), 3608.

In the present invention, a charge generation layer is disposed on a support and a charge transport layer is disposed on the charge generation layer. The charge generation layer and the charge transport layer constitute a photosensitive layer as a whole.

The charge generation layer may generally be prepared by mixing TiOPc, an azo pigment and a hindered phenol together with a binder resin in an appropriate solvent and applying the resultant mixture by ordinary coating method, followed by drying the resultant coating. The charge transport layer may be prepared in the same manner as in the case of the charge generation layer except for mixing a charge-transporting material instead of the TiOPc the azo pigment an the hindered phenol.

Examples of the charge-transporting material used in the present invention may include: triarylamine compounds, hydrazone compounds, stilbene compounds, pyrazoline compounds, oxazole compounds, thiazole compounds and triaryl methane compounds.

Examples of the binder resin used in the respective layers constituting the photosensitive layer may include: polyester, acrylic resins, polyvinylcarbazole, phenoxy resins, polycarbonate, polyvinyl butyral, polystyrene, vinyl acetate resins, polysulfone, polyarylate and vinylidene chloride-acrylonitrile copolymers.

The coating method used for forming the respective layers may include: dipping, spray coating, spinner coating, roller coating, wire bar coating and blade coating.

In the present invention, TiOPc and the azo pigment may preferably be contained in the charge generation layer in a total amount of 20–80 wt. %, particularly 30–70 wt. %. In this instance, a mixing ratio of (TiOPc)/(azo pigment) may preferably be 20/1 to 3/7, more preferably be 15/1 to 4/6, particularly be above 1/1. The hindered phenol may preferably be contained in the charge generation layer in a proportion thereof to the total amount of the TiOPc and the azo pigment (i.e., hindered phenol/(TiOPc)+(azo pigment)) being 1/100 to 1/1, particularly 5/100 to 60/100. The charge-transporting material may preferably be contained in the charge transport layer in an amount of 20–70 wt. %, particularly 30–65 wt. %.

The charge generation layer may preferably have a thickness of 0.05–1.0 μm, particularly 0.1–0.5 μm, and the charge transport layer may preferably have a thickness of 5–50 μm, particularly 8–20 μm.

In the present invention, a charge-generating material contained in a photosensitive layer comprises at least TiOPc and an azo pigment as described above but may optionally include one or two or more other organic pigments in combination.

A particularly preferred embodiment of the photosensitive member according to the present invention is one at least including a charge generation layer and a charge transport layer functionally separated on a support, wherein the charge generation layer contains I-type TiOPc as described above, an azo pigment of the above-mentioned formula (4) and a hindered phenol of the above-mentioned formula (I-25).

The support used in the present invention may preferably be composed of an electroconductive material such as aluminum, aluminum alloy or stainless steel or composed of a material such as plastic, paper or metal on which an electroconductive surface layer is formed. The electroconductive surface layer may preferably be formed by vacuum vapor deposition of aluminum, aluminum alloy or indium oxide—tin oxide alloy or by mixing electroconductive particles, such as carbon black and tin oxide particles, with a binder and then applying the mixture. The electroconductive surface layer may preferably have a thickness of 1–30 μm. The support used in the present invention may preferably be formed in a cylindrical shape or a film (or sheet) shape.

In the present invention, it is possible to dispose an undercoat (or primer) layer having a barrier function and an adhesive function, as desired, between the support (or the electroconductive surface layer) and the photosensitive layer. The undercoat layer may comprise casein, polyvinyl alcohol, nitro cellulose, ethylene-acrylic acid (or acrylate) copolymer, polyamide, modified polyamide, polyurethane, gelatin, aluminum oxide. The undercoat layer may preferably have a thickness of at most 5 μm, particularly 0.5–3 μm. The undercoat layer may desirably have a resistivity of at least $10^7$ ohm.cm.

Between the support (or the electroconductive surface layer) and the undercoat layer, an electroconductive layer may suitably be formed, as desired, in order to cover defects on the support and/or prevent interference fringes due to scattering of laser light in the case where laser light is used for inputting image data. The electroconductive layer can be formed by dispersing electroconductive powder, such as carbon black, metal particles or metal oxide particles, in a binder resin and then applying the dispersion. The electroconductive layer may preferably have a thickness of 5–40 μm, particularly 10–30 μm.

On the photosensitive layer (actually the charge transport layer), it is possible to dispose a protective layer, as desired. The protective layer may comprise a resin such as polyvinyl butyral, polyester, polycarbonate (e.g., polycarbonate Z or modified polycarbonate), nylon, polyimide, polyarylene, polyurethane, styrene-butadiene copolymer, styrene-acrylic acid (or acrylate) copolymer, styrene-acrylonitrile copolymer. The protective layer can be formed by dissolving such a resin in an appropriate organic solvent and applying the solution on the photosensitive layer, followed by drying. The protective layer may preferably have a thickness of 0.05–20 μm. The protective layer may further contain electroconductive particles, such as metal oxide particles (e.g., tin oxide particles), or an ultraviolet light absorber.

In the present invention, the photosensitive layer or the protective layer may further contain other additives including a lubricant such as inorganic fillers, polyethylene, polyfluoroethylene or silica; a dispersant; a silicone oil; a leveling agent; a metallic soap; and a silane coupling agent.

FIG. 1 shows a schematic structural view of an ordinary transfer-type electrophotographic apparatus using an electrophotographic photosensitive member of the invention. Referring to FIG. 1, a photosensitive drum (i.e., photosensitive member) 1 is rotated about an axis la at a prescribed peripheral speed in the direction of the arrow shown inside of the photosensitive drum 1. The surface of the photosensitive drum is uniformly charged by means of a charger (charging means) 2 to have a prescribed positive or negative potential. The photosensitive drum 1 is imagewise exposed to light-image L (as by slit exposure or laser beam-scanning exposure) by using an image-exposure means (not shown), whereby an electrostatic latent image corresponding to an exposure image is successively formed on the surface of the photosensitive drum 1. The electrostatic latent image is developed with a toner by a developing means 4 to form a toner image. The toner image is successively transferred to a recording material 9 which is supplied from a supply part (not shown) to a position between the photosensitive drum 1 and a transfer corona charger (transfer means) 5 in synchronism with the rotating speed of the photosensitive drum 1, by means of the transfer corona charger 5. The recording material 9 with the toner image thereon is separated from the photosensitive drum 1 to be conveyed to an image-fixing device (image-fixing means) 8, followed by image fixing to print out the recording material 9 as a copy product outside the electrophotographic apparatus. Residual toner particles on the surface of the photosensitive drum 1 after the transfer are removed by means of a cleaner (cleaning means) 6 to provide a cleaned surface, and residual charge on the surface of the photosensitive drum 1 is erased by a pre-exposure means 7 to prepare for the next cycle. As the charger 2 for charging the photosensitive drum 1 uniformly, a corona charger is widely used in general.

Figure 2:
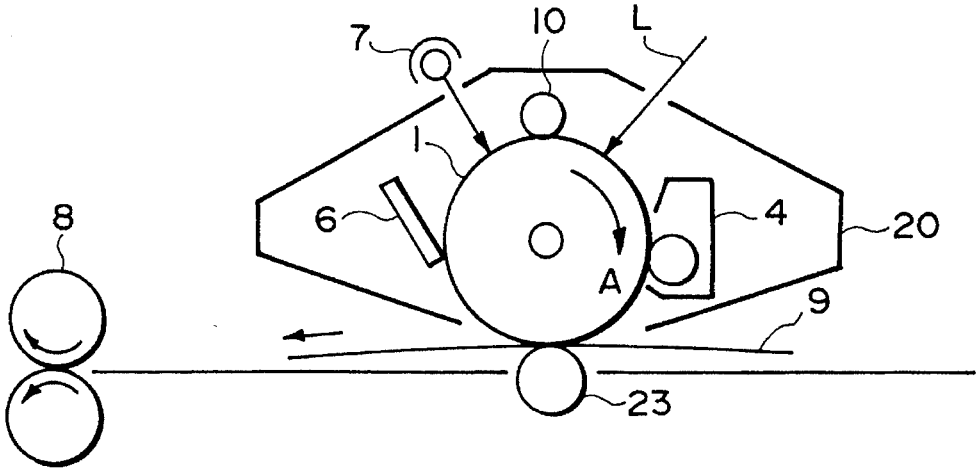
Figure 3:
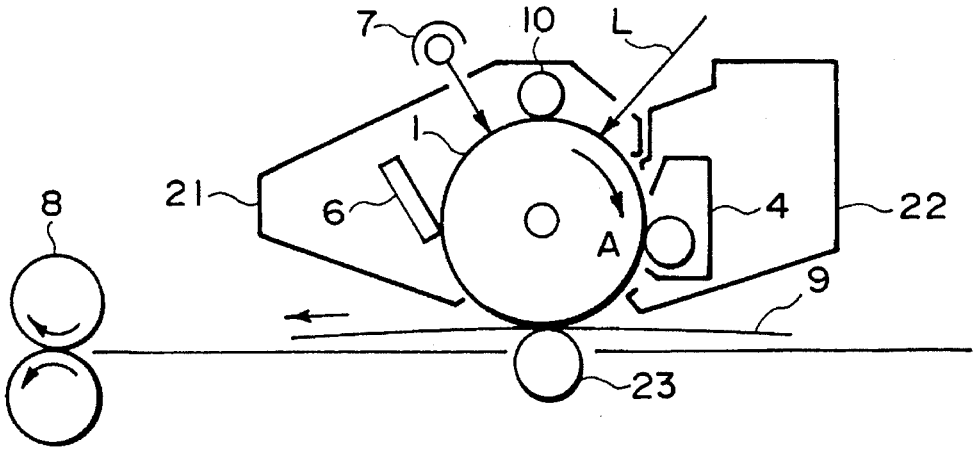
Figure 4:
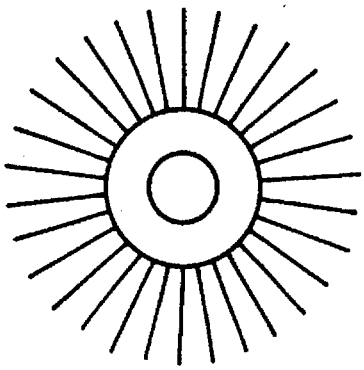
FIG. 4 is a schematic view of an embodiment of a brush-like charging member usable in the present invention.

In FIGS. 2 and 3, a direct charging means 10 as a charging means is used for directly charging the photosensitive drum (member) 1. Specifically, the direct charging means 10 supplied with a voltage is caused to be in contact with the photosensitive member 1 directly to effect direct charging of the photosensitive member 1. In apparatus as shown in FIGS. 2 and 3, toner images formed on the photosensitive member 1 are transferred to a recording member 9 by a direct charging member 23. Specifically, a voltage-applied direct charging member 23 is caused to be in contact with the recording member 9 directly, thus transferring the toner images formed on the photosensitive member 1 onto the recording material 9. The direct charging member 10 may preferably be an electroconductive rubber roller or a brush-shaped charging member as shown in FIG. 4. In FIGS. 2 and 3, the respective reference numerals mean the same members as those described above (in FIG. 1).

In the electrophotographic apparatus shown in FIG. 2, at least three members comprising a photosensitive member 1, a direct charging member 10 and a developing means 4 are integrally supported to form a single unit (electrophotographic apparatus unit), such as a container or process cartridge 20, being attachable to or detachable from an apparatus body by using a guiding means such as a rail within the apparatus body. In this case, a cleaning means 6 may be disposed in the container 20.

In the electrophotographic apparatus shown in FIG. 3, a first electrophotographic apparatus unit comprising at least two members of a photosensitive member 1 and a direct charging member 10 installed in a container 21 and a second electrophotographic apparatus unit comprising at least a developing means 4 installed in a container 22 are disposed attachably to or detachably from an apparatus body. In this case, a cleaning means 6 may be disposed in the container 21.

In a case where the electrophotographic apparatus is used as a copying machine or a printer, exposure light-image L may be given by using reflection light or transmitted light from an original or by reading data on the original, converting the data into a signal and then effecting a laser beam scanning, a drive of LED array or a drive of a liquid crystal shutter array.

The electrophotographic photosensitive member according to the present invention can be applied to not only an ordinary electrophotographic copying machine but also a facsimile machine, a laser beam printer, a light-emitting diode (LED) printer, a cathode-ray tube (CRT) printer, a liquid crystal printer, and other fields of applied electrophotography including, e.g., laser plate making.

Hereinbelow, the present invention will be explained more specifically with reference to examples. In the following examples, "part(s)" and "%" are all by weight.

EXAMPLE 1

Onto the peripheral surface of an aluminum cylinder (outer diameter=30 mm, length=254 mm), a solution of 5 parts of 6-66-610-12 quaternary polyamide copolymer ("Amilan CM8000, manufactured by Toray K. K.) in a mixture solvent of 70 parts of methanol and 25 parts of butanol was applied by dipping, followed by drying to form a 0.65 μm-thick undercoat layer.

Then, 10.5 parts of an oxytitanium phthalocyanine (TiOPc) crystal showing a X-ray diffraction pattern having main beaks specified by Bragg angles (2θ±0.2 degree) of 9.0 degrees, 14.2 degrees, 23.9 degrees and 27.1 degrees, and 1.5 parts of an azoxy pigment of the formula (4) were added to a solution of 10 parts of polyvinyl butyral ("S-LEC BX-1", mfd. by Sekisui Kagaku Kogyo K. K.) in 250 parts of cyclohexanone and were dispersed in a sand mill by using 1 mmϕ-glass beads. To the dispersion, 2 parts of hindered phenol of the formula (I-25) was added and the resultant mixture was diluted with ethyl acetate, thus preparing a coating liquid for a charge generation layer. The coating liquid was applied onto the undercoat layer and dried for 10 minutes at 80 ° C. to form a 0.25 μm-thick charge generation layer.

10 parts of a bisphenol Z-type polycarbonate resin (viscosity-average molecular weight=20,000) and 10 parts of a charge-transporting material of the formula:

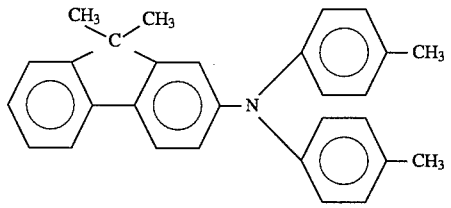

were dissolved in 80 parts of methylene chloride to prepare a coating liquid for a charge transport layer. The coating liquid was applied onto the above charge generation layer by dip coating and dried for 1 hour at 110 ° C. to form a 24 μm-thick charge transport layer, thus preparing an electrophotographic photosensitive member according to the present invention.

EXAMPLE 2

An electrophotographic photosensitive member was prepared in the same manner as in Example 1 except that the addition amount of the hindered phenol was changed to 5.5 parts.

EXAMPLE 3

An electrophotographic photosensitive member was prepared in the same manner as in Example 1 except that the addition amount of the hindered phenol was changed to 0.65 part.

EXAMPLE 4

An electrophotographic photosensitive member was prepared in the same manner as in Example 1 except that the hindered phenol was changed to a hindered phenol of the formula (I-26).

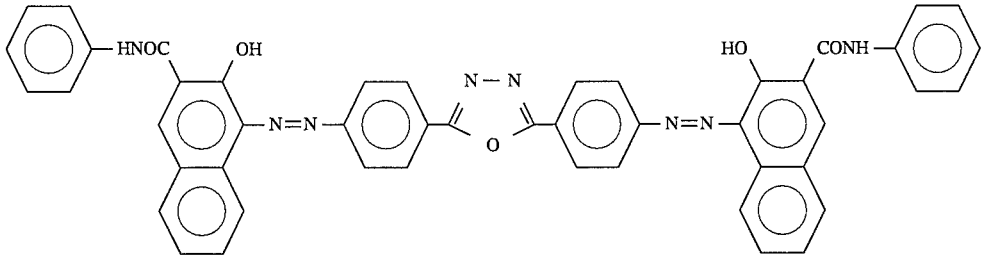

COMPARATIVE EXAMPLE 1

An electrophotographic photosensitive member was prepared in the same manner as in Example 1 except that the hindered phenol was not used.

COMPARATIVE EXAMPLE 2

An electrophotographic photosensitive member was prepared in the same manner as in Example 1 except that 2 parts of a hindered phenol (of the formula (I-25) identical to that used in Example 1 was used in the charge transport layer instead of the charge generation layer.

COMPARATIVE EXAMPLE 3

An electrophotographic photosensitive member was prepared in the same manner as in Example 1 except that the azoxy pigment is not used.

COMPARATIVE EXAMPLE 4

An electrophotographic photosensitive member was prepared in the same manner as in Example 1 except that the azoxy pigment and the hindered phenol were not used and that the addition amount of the TiOPc (oxytitanium phthalocyanine) crystal was changed to 12 parts.

EXAMPLE 5

An electrophotographic photosensitive member was prepared in the same manner as in Example 1 except that the TiOPc crystal was changed to a TiOPc crystal showing an X-ray diffraction pattern having main peaks specified by Bragg angles (2θ±0.2 degrees) of 9.3 deg., 10.6 deg., 13.2 deg., 15.1 deg., 20.8 deg., 23.3 deg., 26.3 deg., and 27.1 deg., and that the azoxy pigment was changed to an azo pigment of the formula:

EXAMPLE 6

An electrophotographic photosensitive member was prepared in the same manner as in Example 1 except that the TiOPc crystal was changed to a TiOPc crystal showing an X-ray diffraction pattern having main peaks specified by Bragg angles (2θ±0.2 degrees) of 9.5 deg., 9.7 deg., 11.7 deg., 15.0 deg., 23.5 deg., 24.1 deg., and 27.3 deg., and that the azoxy pigment was changed to an azo pigment of the formula:

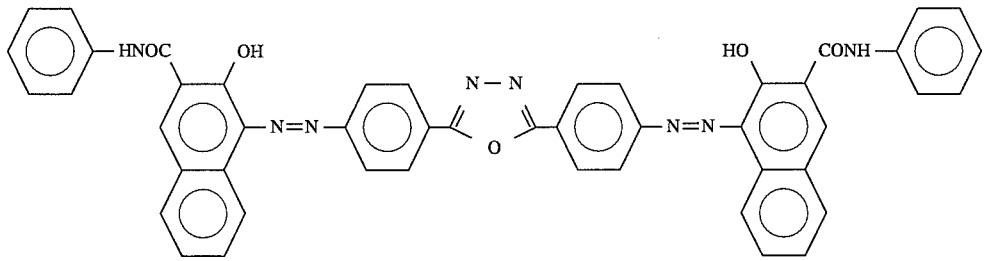

EXAMPLE 7

An electrophotographic photosensitive member was prepared in the same manner as in Example 1 except that a 6 μm-thick protective layer was further formed on the charge transport layer in the following manner.

A coating liquid for a protective layer was prepared by dispersing 30 parts of polytetrafluoroethylene particles ("Daikin Polyflon TFE Low Polymer L-5", mfd. by Daikin Kogyo K. K.) and 1.2 parts of a fluorine-containing comb-like graft polymer ("ARON GF-300", mfd. by Toa Gosei Kagaku Kogyo K. K.) in a solution of 30 parts of a bisphenol Z-type polycarbonate resin (viscosity-average molecular weight=80000) and 30 parts of a charge-transporting material identical to that used in Example 1 in 500 parts of monochlorobenzene in a ball mill.

Then, the coating liquid was applied onto the charge transport layer by spray coating to form a 6 μm-thick protective layer.

Each of the electrophotographic photosensitive members prepared in Examples 1–7 and Comparative Examples 1–4 was installed in a laser beam printer ("LBP-LX", mfd. by Canon K. K.) and subjected to a successive copying (or recording) test of 1000 sheets of recording paper under an environmental condition of 10° C. and 20% RH (L/L condition) to evaluate a fluctuation in light part potential (referred to as "L/L potential change") by measuring a light part potential (V1) at an initial stage and a light part potential after the copying test of 1000 sheets. In this instance, each of the photosensitive members was charged so as to have a dark part potential (Vd) of −600 V and then exposed to laser light (emission wavelength: 780 nm) so as to have a light part potential (V1) of −170 V. The results are shown in Table 1 appearing hereinbelow.

Then, each of the electrophotographic photosensitive members newly prepared in accordance with Examples 1–7 and Comparative Examples 1–4 was exposed to a white fluorescent lamp (light quantity (illuminance): 1500 lux) for 5 minutes. After 1 minute, each of the photosensitive members was installed in the above laser beam printer (LBP-LX) to perform charging and exposure processes, whereby a deviation of light part potential (V1) from a desired value corresponding to the set point (referred to a "P.M. ΔV1") was measured in an environment of 23° C. and 50% RH, thus evaluating a photomemory characteristic. The results are also shown in Table 1.

Separately, each of the electrophotographic photosensitive members newly prepared in accordance with Examples 1–7 and Comparative Examples 1–4 was installed in the laser beam printer (LBP-LX) described above and subjected to a copying (or recording) test in an environment of 23° C. and 50% RH to effect image evaluation as follows.

First, a successive copying of 2000 sheets was performed as to A4-sized recording paper on which parallel lines with a spacing of 1 cm were formed lengthwise and breadthwise in the entire image area. Immediately thereafter, a halftone (gray) image (Image A) was formed on the above A4-sized recording paper. Then, the laser beam printer (LBP-LX) was left standing for 24 hours without effecting image formation (or recording) and was again subjected to image formation of a halftone image (Image B).

Then, image evaluation was performed based on the following evaluation standards.

1: No crossed parallel lines appeared in Image A as well as in Image B.

2: Crossed parallel lines slightly appeared in Image A but did not appeared in Image B.

3: Crossed parallel lines appeared both in Image A and in Image B.

The results are also shown in Table 1 below.

TABLE 1

| Example No. | L/L potential change (V) | P.M. ΔV1 (V) | Image evaluation |
|---|---|---|---|
| Ex. 1 | 0 | −10 | 1 |
| Ex. 2 | 0 | −5 | 1 |
| Ex. 3 | 0 | −15 | 1 |
| Ex. 4 | 0 | −15 | 1 |
| Comp. Ex. 1 | −150 | −30 | 2 |
| Comp. Ex. 2 | −100 | −30 | 2 |
| Comp. Ex. 3 | −70 | −60 | 3 |
| Comp. Ex. 4 | −150 | −60 | 3 |
| Ex. 5 | −10 | −15 | 1 |
| Ex. 6 | −10 | −15 | 1 |
| Ex. 7 | 0 | −10 | 1 |

As described hereinabove, by using an azo pigment and a hindered phenol in combination with TiOPc in a charge generation layer, it is possible to provide an electrophotographic photosensitive member showing stable electric potential and good image-forming characteristics even after repetitive use and exhibiting an improved photomemory characteristic.

What is claimed is:

1. An electrophotographic photosensitive member, comprising: a support, a charge generation layer disposed on the support and a charge transport layer disposed on the charge generation layer, wherein said charge generation layer comprises oxytitanium phthalocyanine, a bisazo pigment and a hindered phenol.

2. A member according to claim 1, wherein said oxytitanium phthalocyanine has a crystal form characterized by main peaks specified by Bragg angles (2θ±0.2 degree) of 9.0 degrees, 14.2 degrees, 23.9 degrees and 27.1 degrees in X-ray diffraction pattern based on CuKα characteristic X-rays.

3. A member according to claim 1, wherein said oxytitanium phthalocyanine has a crystal form characterized by main peaks specified by Bragg angles (2θ±0.2 degrees) of 7.6 degrees and 28.6 degrees in X-ray diffraction pattern based on CuKα characteristic X-rays.

4. A member according to claim 1, wherein said oxytitanium phthalocyanine has a crystal form characterized by main peaks specified by Bragg angles (2θ±0.2 degree) of 9.3 degrees and 26.3 degrees in X-ray diffraction pattern based on Cukα characteristic X- rays.

5. A member according to claim 1, wherein said oxytitanium phthalocyanine has a crystal form characterized by main peaks specified by Bragg angles (2θ±0.2 degrees) of 9.5 degrees and 27.3 degrees in X-ray diffraction pattern based on CuKα characteristic X-rays.

6. A member according to claim 1, wherein said bisazo pigment is selected from the group consisting of formulae (1) to (3):

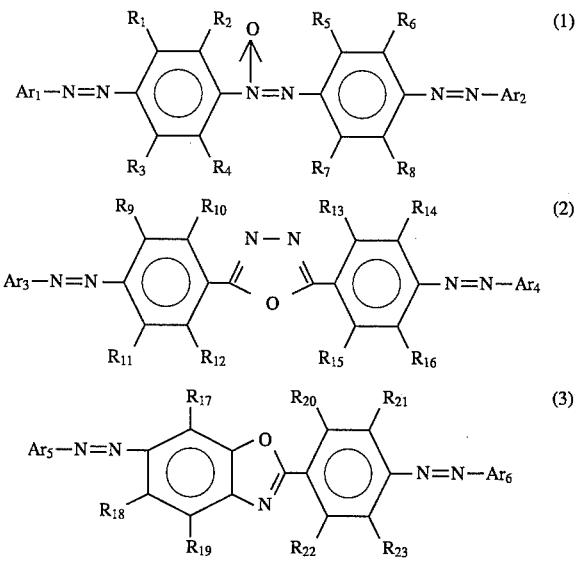

in which $Ar_1$ to $Ar_6$ denote a coupler residue and each of $R_1$ to $R_{23}$ denotes alkyl group, aryl group, hydrogen atom or halogen atom.

7. A member according to claim 1, wherein said hindered phenol contains sulfur atom.

8. An electrophotographic apparatus, comprising: an electrophotographic photosensitive member according to claim 1, a charging means for charging the electrophotographic photosensitive member, an image-exposure means for effecting image-exposure to the electrophotographic photosensitive member to form an electrostatic latent image, and a developing means for developing the electrostatic latent image with a toner.

9. An apparatus according to claim 8, wherein said charging means comprises a direct charging member.

10. An electrophotographic apparatus unit, comprising: an electrophotographic photosensitive member according to claim 1 and a direct charging member contacting and charging the electrophotographic photosensitive member.

11. A unit according to claim 10, which further comprises a developing means for developing an electrostatic latent image formed on the electrophotographic photosensitive member.

* * * * *